US006420685B1

(12) United States Patent
Tanamachi

(10) Patent No.: US 6,420,685 B1
(45) Date of Patent: Jul. 16, 2002

(54) CONTROL OF ELECTRICAL HEATER TO REDUCE FLICKER

(75) Inventor: Steven W. Tanamachi, Lauderdale, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/742,977

(22) Filed: Dec. 20, 2000

(51) Int. Cl.[7] ..... H05B 1/00

(52) U.S. Cl. ..... 219/501; 219/486; 219/216; 219/508; 399/69

(58) Field of Search ..... 219/501, 216, 219/497, 499, 506, 505; 399/67, 69

(56) References Cited

U.S. PATENT DOCUMENTS 5,907,743 A * 5/1999 Takahashi ..... 399/69
6,097,006 A * 8/2000 Inukai ..... 219/497
6,111,230 A * 8/2000 Cao et al. ..... 219/501
6,114,669 A * 9/2000 Van Mil et al. ..... 210/497

* cited by examiner

*Primary Examiner*—Mark Paschall
(74) *Attorney, Agent, or Firm*—William F. Noval

(57) ABSTRACT

A control system for reducing flicker in an electrical resistance heater comprising: a source of AC (alternating current) current for supplying AC current to an electrical resistance heater; a bidirectional solid state switching device connected between said source and said electrical resistance heater, and a control circuit for controlling the bidirectional solid state switching device to supply a varying, phase controlled duty cycle of current to said heater which effectively ramps heater power up and down in response to a binary control signal which randomly turns on said switching device.

6 Claims, 8 Drawing Sheets

CONTROL OF ELECTRICAL HEATER TO REDUCE FLICKER

FIELD OF THE INVENTION

This invention relates in general to apparatus for controlling temperature and, more particularly, to apparatus for controlling the temperature of a resistive electrical heater to reduce flicker.

BACKGROUND OF THE INVENTION

Photothermography is an established imaging technology. In photothermography, a photosensitive media is exposed to radiation to create a latent image which can then be thermally processed to develop the latent image. Devices and methods for implementing this thermal development process are generally known and include contacting the imaged photosensitive media with a heated platen, drum or belt, blowing heated air onto the media, immersing the media in a heated inert liquid and exposing the media to radiant energy of a wavelength to which the media is not photosensitive, e.g., infrared. Of these conventional techniques, the use of heated drums is particularly common.

A common photosensitive media useable in these imaging processes is known as a photothermographic media, such as film and paper. One photothermographic media has a binder, silver halide, organic salt of silver (or other deducible, light-insensitive silver source), and a reducing agent for the silver ion. In the trade, these photothermographic media are known as dry silver media, including dry silver film.

In order to precisely heat exposed photothermographic media, including film and paper, it has been found to be desirable to use electrically heated drums. In apparatus employing this technique, a cylindrical drum is heated to a temperature near the desired development temperature of the photothermographic media. The photothermographic media is held in close proximity to the heated drum as the drum is rotated about its logitudinal axis. When the temperature of the surface of the heated drum is known, the portion of the circumference around which the photothermographic media is held in close proximity is known and the rate of rotation of the drum is known, the development time and temperature of the thermographic media can be determined. Generally, these parameters are optimized for the particular photothermographic media utilized and, possibly, for the application in which the photothermographic media is employed.

U.S. Pat. No. 5,580,478, issued Dec. 3, 1996, inventors Tanamachi et al., discloses a temperature controlled, electrically heated drum for developing exposed photothermographic media. A cylindrical drum has a surface and is rotatable on an axis. An electrical heater is thermally coupled to the surface of the cylindrical drum. A temperature control mechanism, rotatably mounted in conjunction with the cylindrical drum and electrically coupled to the electrical heater, controls the temperature by controlling the flow of electricity to the electrical heater in response to control signals. A temperature sensor is thermally coupled to the surface of the cylindrical drum. A temperature sensor mechanism, rotatably mounted in conjunction with the cylindrical drum and electrically coupled to the temperature sensor, senses the temperature of the surface of the cylindrical drum and produces temperature signals indicative thereof. A microprocessor, non-rotatably mounted with respect to the cylindrical drum, controls the temperature of the electrically heated drum by generating the control signals in response to the temperature signals. An optical mechanism, coupled to the temperature control means, the temperature sensor means and the microprocessor means, optically couples the temperature signals from the rotating temperature sensor means to the non-rotating microprocessor means and optically couples the control signals from the non-rotating microprocessor means to the rotating temperature control means.

Separate electrical resistance heaters heat a central heat zone and contiguous edge zones. Temperature control of the electrical heaters is obtained through duty cycle modulation. Solid state relays in the power circuit to the electrical heaters are turned on and off with zero crossing triggering.

Although this technique is useful for the purpose for which it was intended, new flicker requirements of regulatory authorities in Europe (EC 65000-3-3) make this control technique unacceptable.

It is therefore desirable to provide a temperature control system for electrical resistor heaters that satisfy the new flicker requirements.

SUMMARY OF THE INVENTION

According to the present invention, there is provided a solution to the problems discussed above.

According to a feature of the present invention, there is provided a control system for reducing flicker in an electrical resistance heater comprising a source of AC (alternating current) current for supplying AC current to an electrical resistance heater, a bidirectional solid state switching device connected between said source and said electrical resistance heater; and a control circuit for controlling said bidirectional solid state switching device to supply a varying, phase controlled duty cycle of current to said heater which effectively ramps heater power up and down in response to a binary control signal which randomly turns on said switching device.

ADVANTAGEOUS EFFECT OF THE INVENTION

The invention has the following advantages.

1. New flicker requirements of a European agency are met without any internal software changes to the temperature control algorithms and with only minor changes to the circuit board.
2. The control technique is simple, cost efficient and effective.

DETAILED DESCRIPTION OF THE INVENTION

Figure 1:
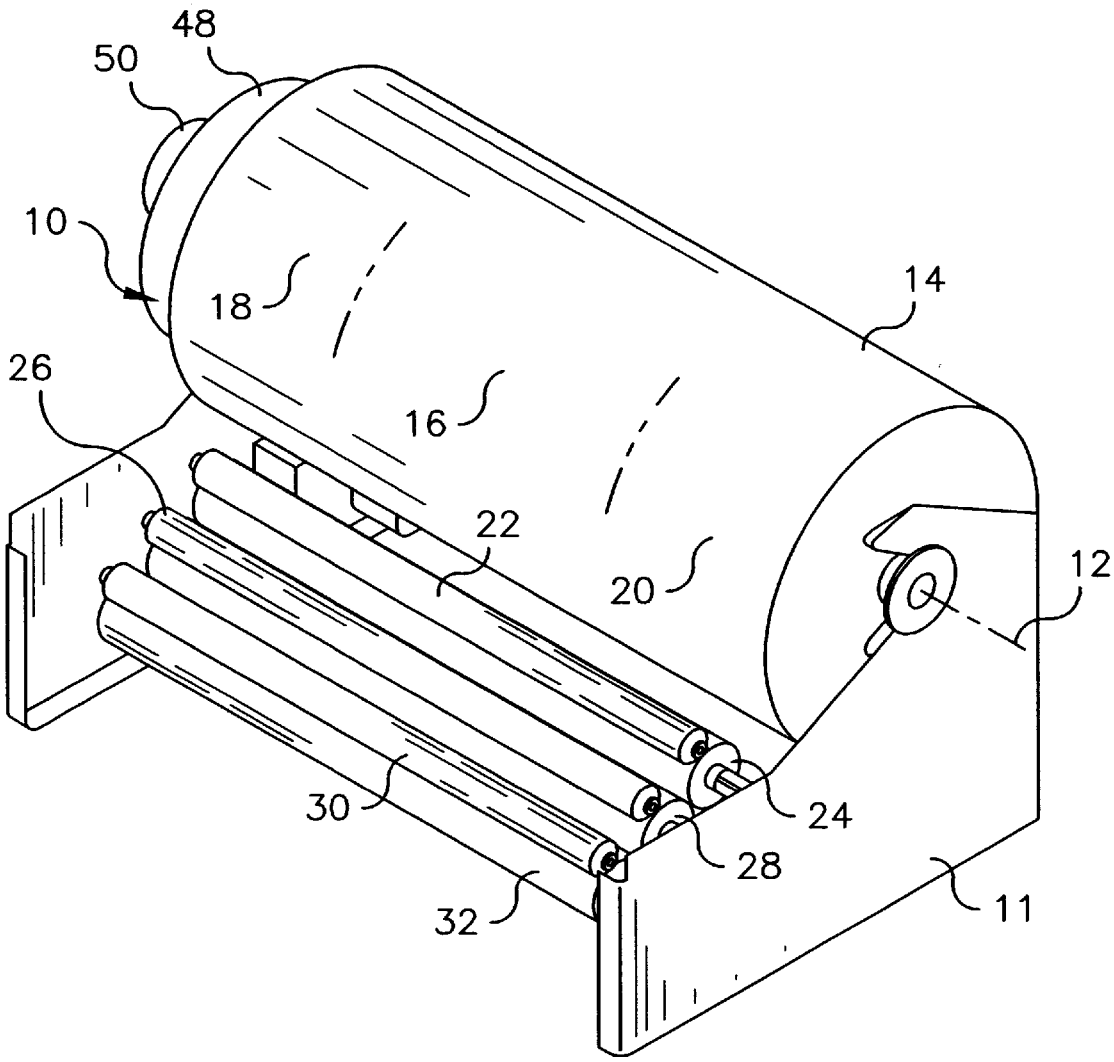
FIG. 1 is a perspective view of a portion of a thermal processor utilizing a rotatable, electrically heated drum.
Figure 2:
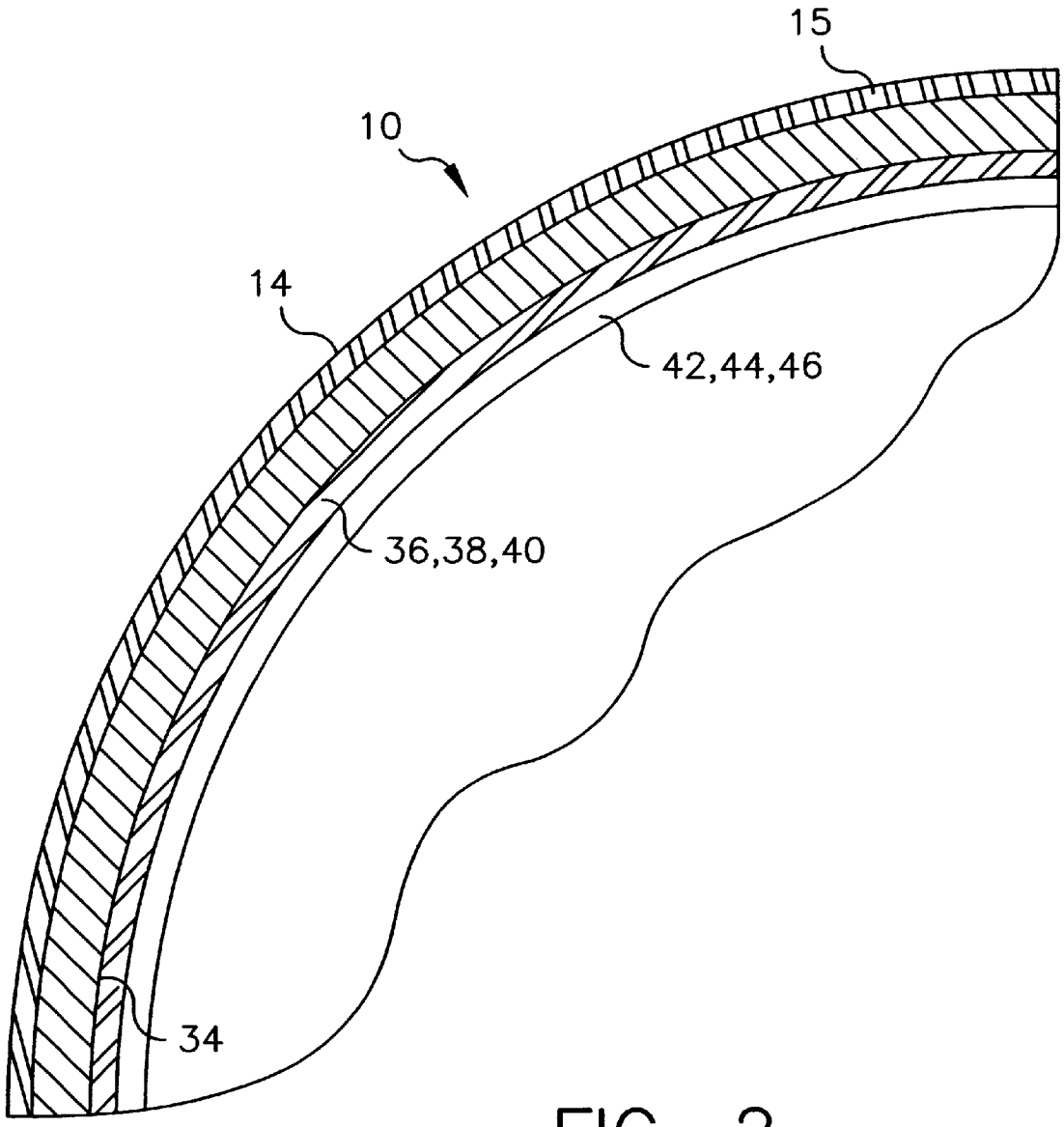
FIG. 2 is a cross-sectional view of the drum shown in FIG. 1.

A portion of a thermal processor utilizing a rotatable electrically heated drum 10 is illustrated in FIGS. 1 and 2.

Such a thermal processor may be used to process diagnostic quality dry silver film. Cylindrical drum 10, mounted on frame 11, is rotatable around axis 12. Optionally, exterior surface 14 of drum may be coated with silicone layer 15. Also optionally, exterior surface 14 of drum 10 is divided into zone separately controlled heating zones. Since the edges of surface 14 of drum 10 may cool faster than the central portion of surface 14, a central zone 16 is controlled independently of edge zones 18 and 20. Photothermographic media (not shown) is held in close proximity of exterior surface 14 of drum 10 over a portion of the circumference of drum 10. With a known temperature of exterior surface 14 of drum 10, typically 255 degrees Fahrenheit, a known rotational rate, typically 2.5 revolutions per minute, and a known portion of circumference of surface 14 over which the photothermographic media passes, a known development temperature and dwell time can be achieved. After heated development, cooling rollers (22, 24, 26, 28, 30 and 32) cool the photothermographic media to a temperature below development temperature.

As an example, cylindrical drum is constructed from aluminum having a diameter of 6.25 inches (15.9 centimeters) and with a hollow interior and shell thickness of 0.25 inches,(0.635 centimeters). Mounted on the interior surface 34 of drum 10 are electrical resistance heaters 36, 38 and 40 adapted to heat zones 18, 16 and 20, respectively. Exterior surface 14 of drum 10 may have a very delicate coating, so temperature measurement of the drum is done internally in order not to damage the surface coating. Mounted on the interior surface 34 of drum 10 are temperature sensors 42, 44 and 46 adapted to sense the temperature of zones 18, 16 and 20, respectively.

Since drum 10 is rotating, communication to electrical resistance heaters 36, 38 and 40 is done by way of rotating circuit board 48 mounted on one end of cylindrical drum 10 which rotates at the same rate as drum 10. Circuit board 48 is controlled by stationary mounted communications circuit board 50 positioned to optically cooperate with rotating circuit board 48. Communication occurs over an optical communications link.

The temperature of exterior surface 14 is typically maintained across drum 10 and from sheet to sheet of photothermographic media to within ±0.5 degrees Fahrenheit in order to produce diagnostic quality images.

Figure 3:
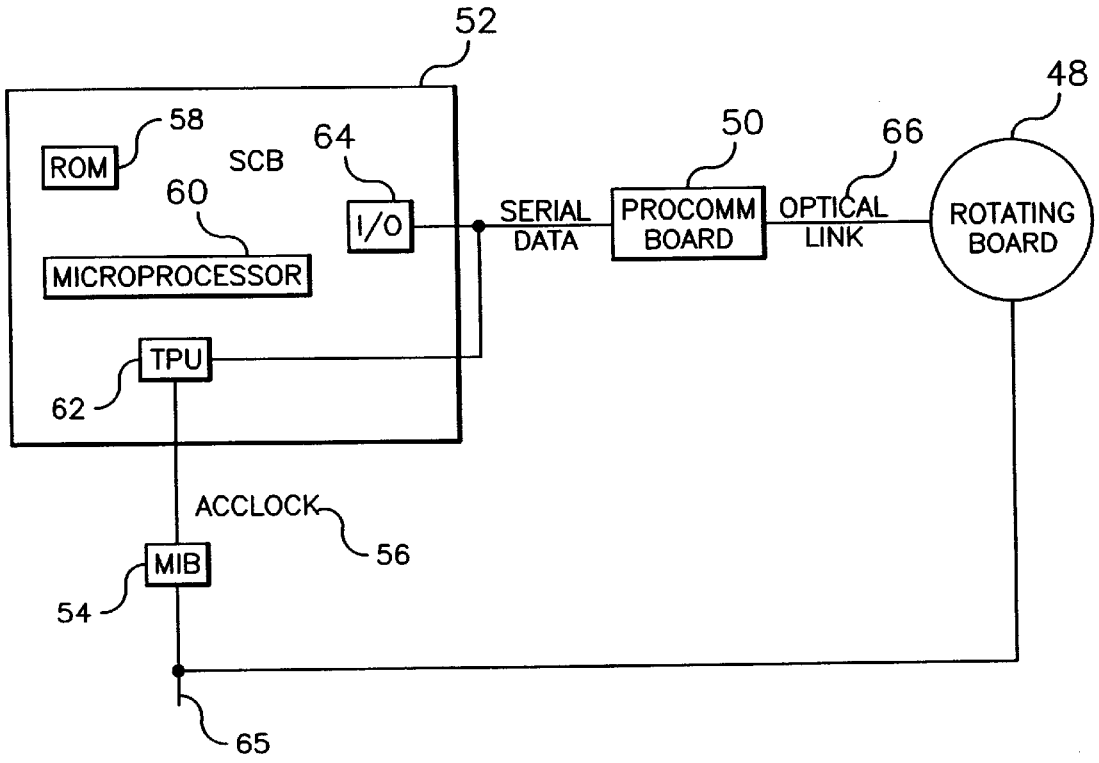
FIG. 3 is a high level block diagram of an electronic temperature control system incorporating the present invention.

A high level block diagram of the major components of the temperature control circuitry is illustrated in FIG. 3. Rotating circuit board 48 rotates with drum 10 to communicate heater control information to drum 10 and to communicate temperature information to software located on system controller board 52 (stationary). Communications board 50 (stationary) converts serial data from system controller board 52 to optical data rotating board 48, and vice versa. Machine interface board 54 supplies an ACCLOCK signal 56 which is used to synchronize serial communications between system controller board 52 and rotating board 48. System controller board 52 provides memory 58 in which the temperature control software resides. Microprocessor 60, time processing unit 62 and I/O unit 64 are used by the software to monitor and regulate the temperature of exterior surface 14 of drum 10.

Figure 4:
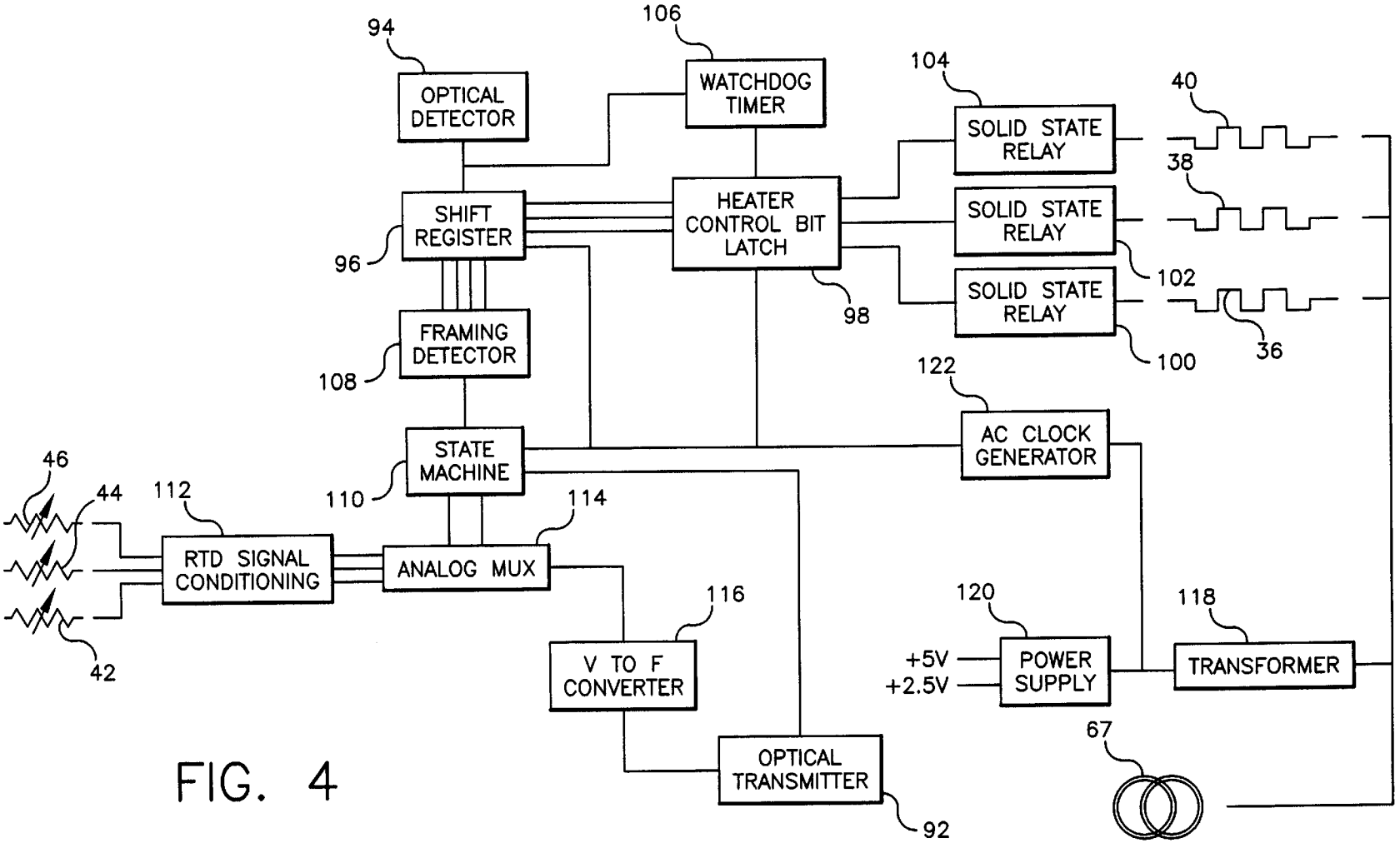
FIG. 4 is a block diagram of a rotating board shown in FIG. 3.

In general, software on system controller board 52 loads heater control data indicating which electrical resistance heaters 36, 38 and 40 to turn on or off into I/O unit 64 to be shifted serially to communication boards 50. Communications board 50 converts the data to an optical signal which is sent to rotating board 48 over optical link 66. Rotating board 66 interprets this data into signals which are used to switch power on or off independently to electrical resistance heaters 36, 38 and 40. In response to the heater control data, rotating board 48 reads data from temperature sensors 42, 44 and 46 and sends this data via optical link 66 to communications board 50. Communications board 50, in turn, sends this data to system controller board 52. In system controller board 52, temperature data is read by time processing unit 62. Software can then read this data and convert the temperature data into temperatures and react accordingly to turn electrical resistance heater 36, 38 and 40 on or off FIG. 4 illustrates a block diagram of rotating board 48 attached to rotating drum 10. Optical transmitter 92 is mounted on the rotational axis of drum 10 facing communications board 50. Optical detector 94, an infrared photosensor, is mounted next to optical transmitter 92 as close as possible to optical transmitter 92 and facing communications board 50. All optical transmitters and sensors face each other across the space between communications board 50 and rotating board 48 at a distance of 0.6 inches (1.5 centimeters).

Control signals for electrical resistance heaters 36, 38 and 40 are received via optical link 66 by optical detector 94. The control information is passed to shift register 96 through heater control bit latch 98 to solid state relay 100 for electrical resistance heater 36, to solid state relay 102 for electrical resistance heater 38 and to solid state relay 104 for electrical resistance heater 40. Watchdog timer 106 watches an interruption in the receipt of the serial data from optical link 66. Received data is also passed from shift register 96 through framing detector 108 received serial data for validity and performs control functions. Temperature data is received from temperature sensors 42, 44 and 46 by RTD signal conditioner 112 and passed to an analog multiplexer 114 under control from state machine 110. Provided the synchronization bits in the serial data received by optical detector 94 are correct, state machine 110 then transmits temperature data through V to F converter 116 to optical transmitter 92 for transmission across optical link 66 to communications board 50. AC power is received by electrical resistance heaters 36, 38 and 40 through slip rings 67. Transformer 118, power supply 120 and AC clock generator 122 (HI 111) provide overhead functions.

Figure 5:
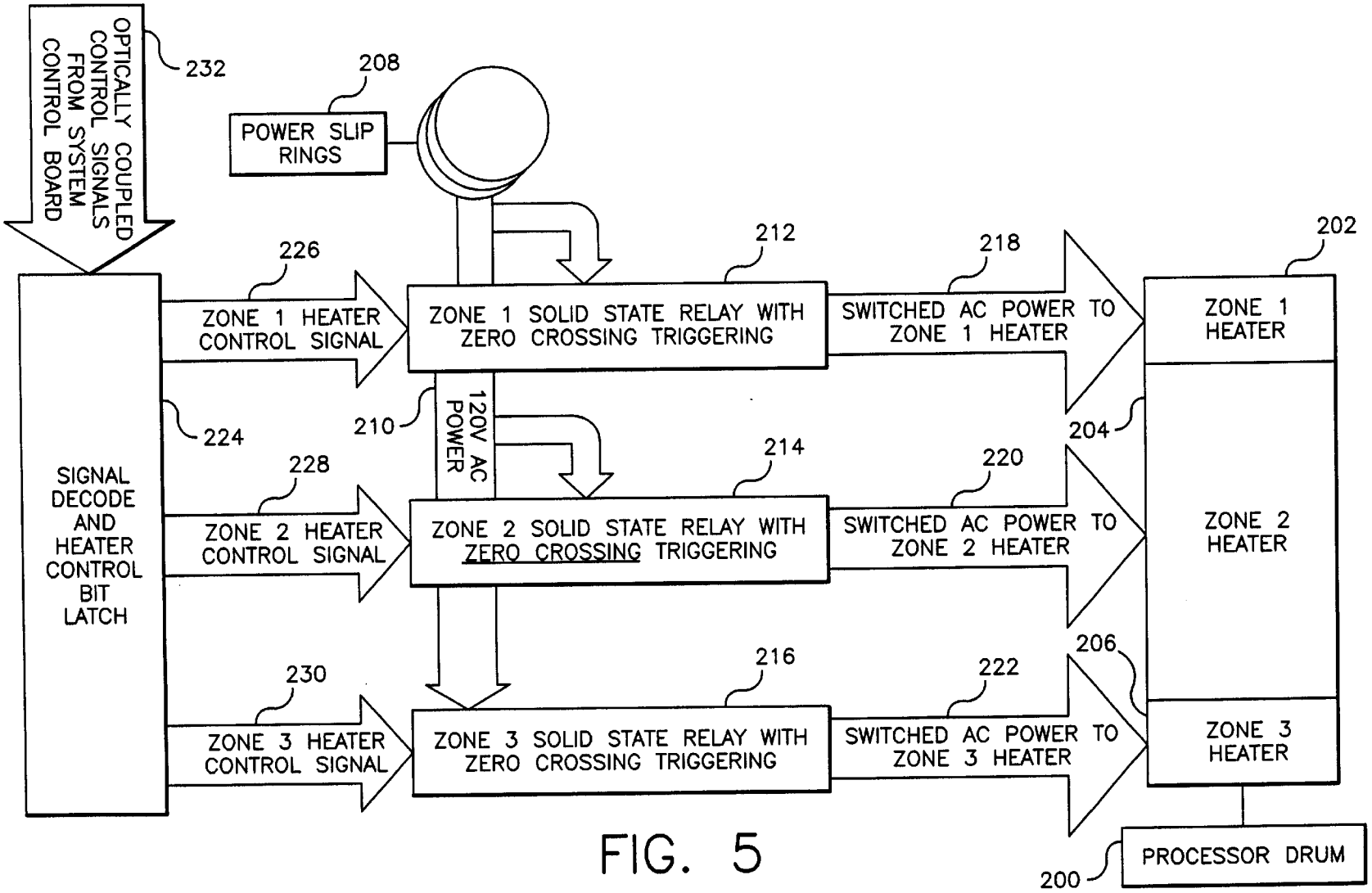
FIG. 5 is a diagrammatic view illustrating the known heater control system.

Referring now to FIG. 5, there is shown a diagrammatic view illustrating a known heater control system. As shown, photothermographic processor drum 200 has electrical resistance Zone 1 heater 202, Zone 2 electrical resistance heater 204 and Zone 3 electrical resistance heater 206. AC power from power slip rings 208 is supplied over bus 210 to Zone 1 solid state relay with zero crossing triggering circuit 212, to Zone 2 solid state relay with zero crossing triggering circuit 214 and to Zone 3 solid state relay with zero crossing triggering circuit 216. Circuits 212, 214 and 216 supply switched AC power respectively to heaters 202, 204 and 206 over respective power links 218, 220 and 222. Circuits 212, 214 and 216 receive heater control signals from signal decode and heater control bit latch 224 over control links 226, 228 and 230. Latch 224 receives optically coupled control signals from the system control board (arrow 132).

Figure 7:
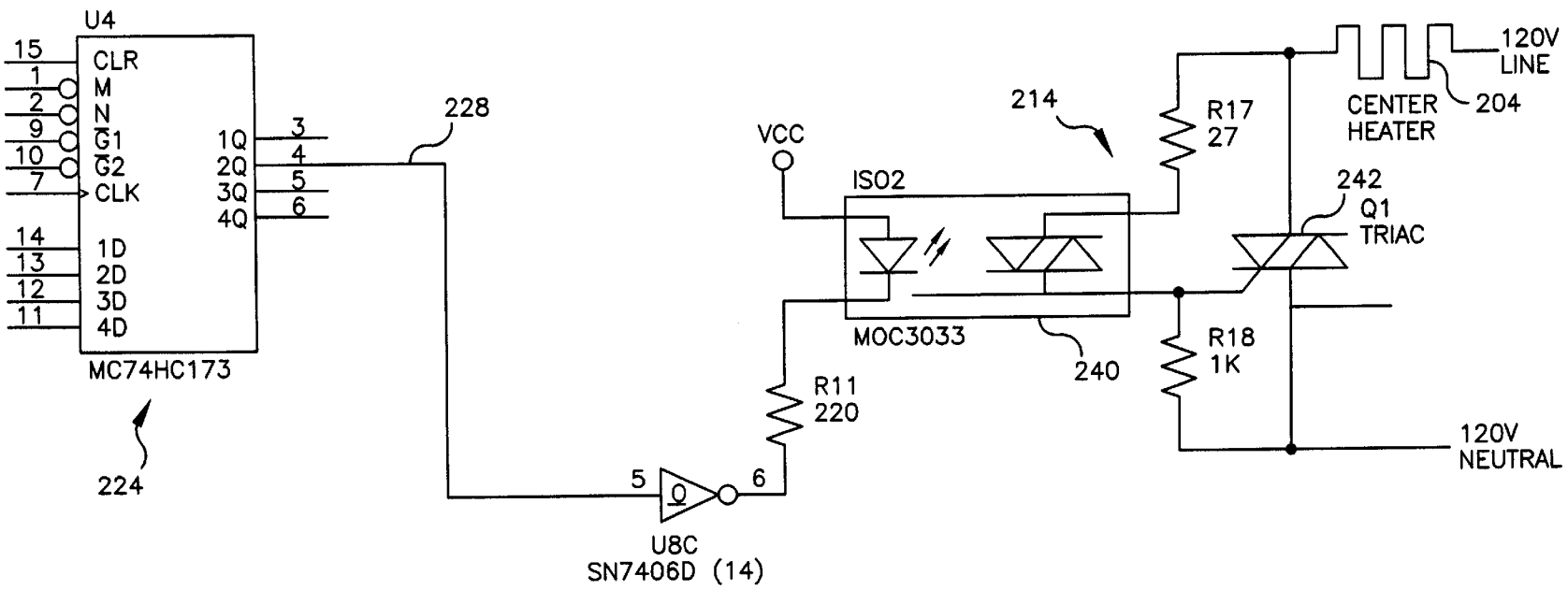
FIG. 7 is a schematic diagram of the system of FIG. 5.

FIG. 7 is a schematic diagram of relevant components of the Zone 2 heater system. Latch 224 is a MC74HC173, whose pin 4 supplies the heater control signal over control link 228. Circuit 114 includes zero crossing optocoupler 240 (IS02 type MOC 3033) and triac 242. The control link 228 from latch 224 pin 4 turns on optocoupler 240 which turns on triac 242 (and thus Zone 2 heater 204 (FIG. 5)) at the next AC line voltage zero crossing and maintains triac 242 in the on state until control link 228 goes low. At this time, the triac 242 will turn off the Zone 2 heater 204 current at the next AC line zero crossing.

The heater control system of FIGS. 5 and 7 has been found not to satisfy the new European flicker standards.

Figure 6:
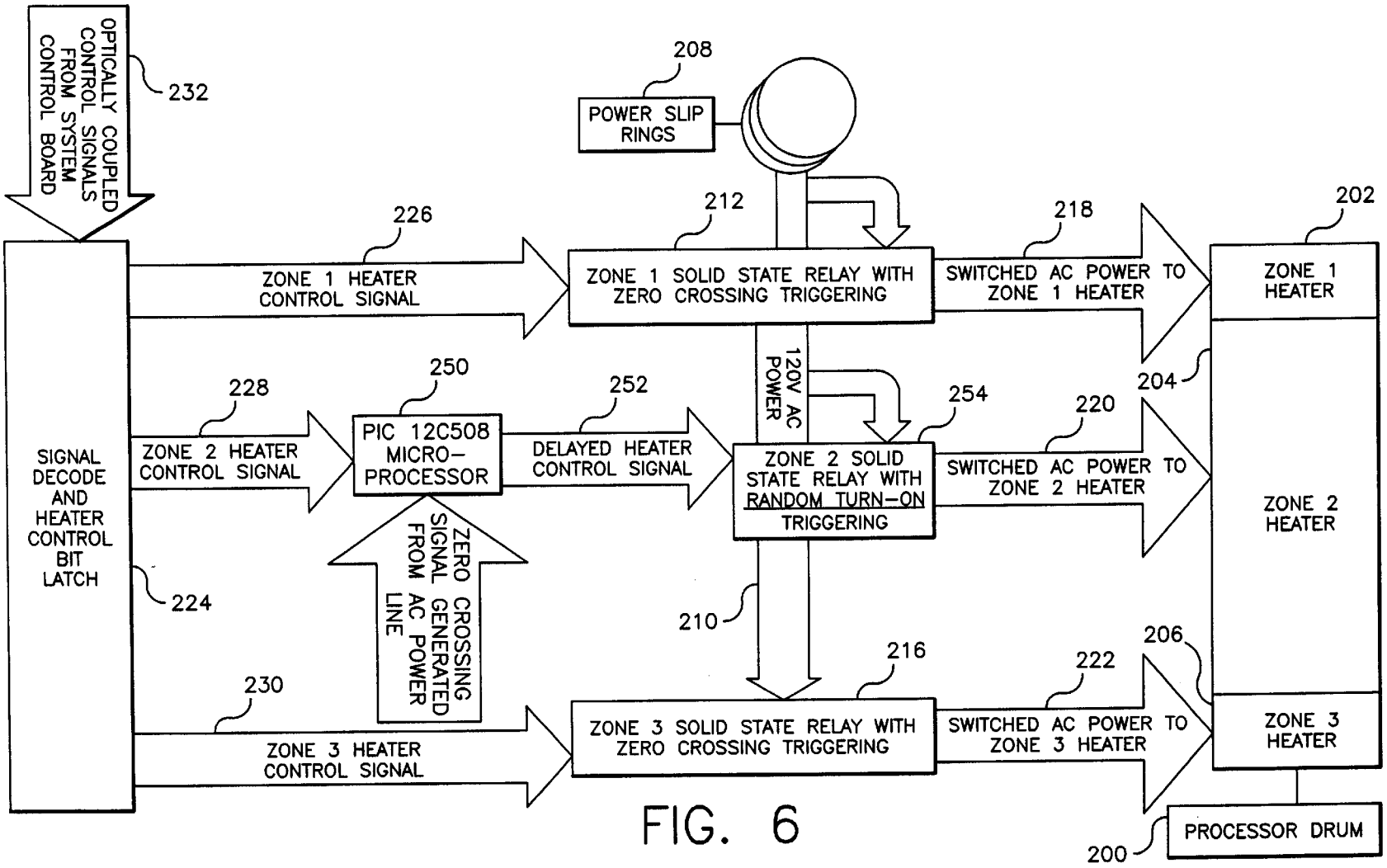
FIG. 6 is a diagrammatic view illustrating the heater control system of the present invention.
Figure 8:
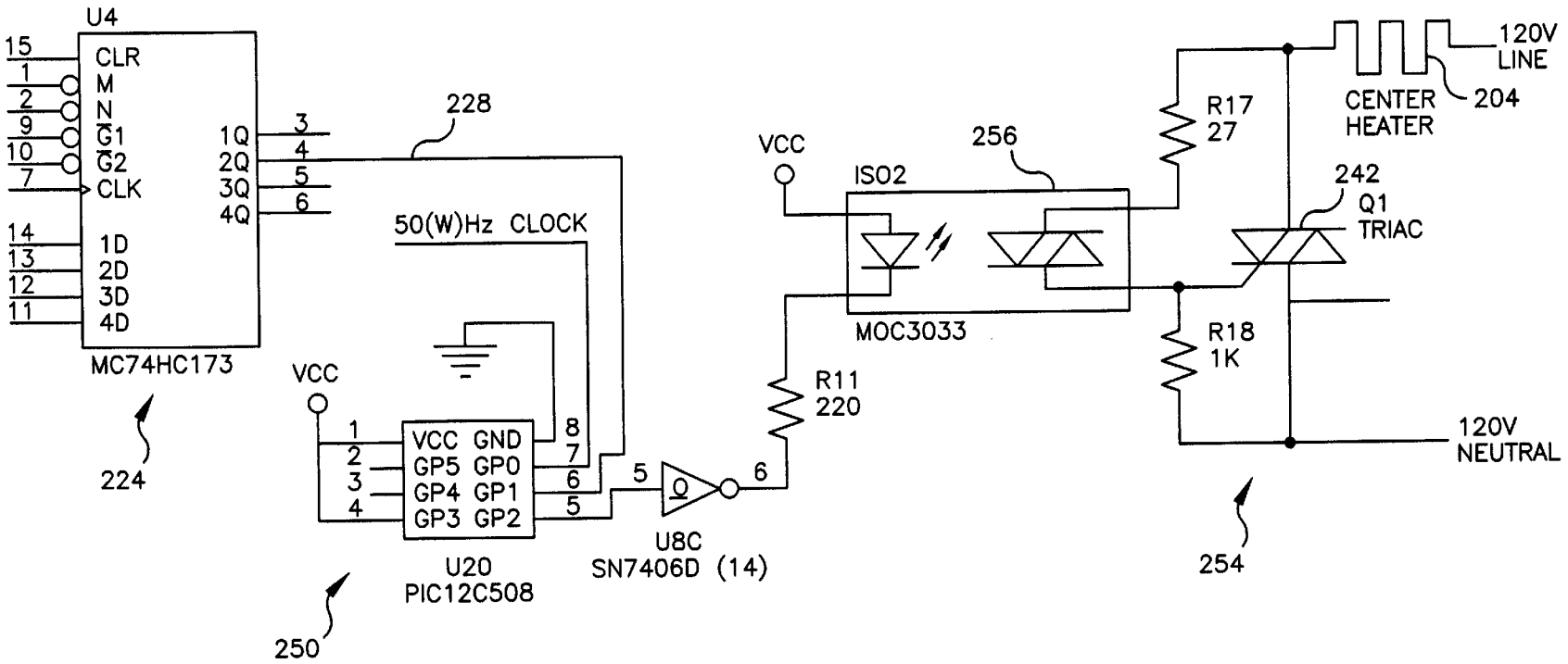
FIG. 8 is schematic diagram of the system of FIG. 6.

According to the present invention, the system of FIGS. 6 and 8 obviates the limitations of the FIGS. 5 and 7 system.

As shown in FIG. 6, the Zone 2 heater control signal on link 228 from latch 224 is supplied to a microprocessor 250 which delays the heater control signal over link 252. The Zone 2 solid state relay circuit 254 operates with random turn-on triggering. FIG. 8 shows microprocessor 250 to be PIC 12C508 and circuit 254 to include IS02 optocoupler 256 and triac 242.

By changing the optocoupler to a type MOC3022, the triac 242 can be turned on at any time (random turn-on). This allows us to turn on the triac 242 with a narrow pulse and the triac will then stay on until the next zero crossing of the AC line.

The program in the PIC microprocessor 250 operates by having two inputs. One is a square wave generated from the AC line and has it's transitions synchronized to the AC line zero crossings. The other input is the digital control line from latch 224 pin 4. When the control input is high, a pulse is generated to the triac 242 after a variable delay time measured from the next AC line zero crossing. This delay time decreases in a linear manner until the delay time goes to zero at which time the triac trigger pulse occurs immediately after the AC line zero crossing. This effectively allows the triac 242 to conduct for the full line cycle and applies maximum power to the heater 204. When the control line goes low the microprocessor 250 increases the delay time in a linear manner until the point is reached where the delay time is greater than the time for ½AC cycle. When this happens, the delay time is restarted and no trigger pulse is generated. This effectively applies no power to the heater 204.

During the time when the delay is increasing or decreasing between these two extremes, the heater 204 is supplied with a varying, phase controlled duty cycle which effectively ramps the heater 204 power up and down in response to the binary control signal. This softens the turn-on and turn-off of the heater 204 and spreads the charge in line current over a longer time, which allows the unit to pass the new European flicker requirements. Moreover, the large expense of hardware and software design and re-qualification of a new design is mitigated, production is not impacted and resources for new product designs are available.

It will be understood that the random turn-on triggering circuit used to control the temperature of Zone 2 heater 204 could also be used to control the temperature of Zone 1 heater 202 and/or Zone 3 heater 206.

The invention has been described in detail with particular reference to certain preferred embodiments thereof, but it will be understood that variations and modifications can be effected within the spirit and scope of the invention.

PARTS LIST

| | |
|---|---|
| 10 | heated drum |
| 11 | frame |
| 12 | axis |
| 14 | exterior surface |
| 15 | silicone layer |
| 16, 18, 20 | edge zones |
| 22, 24, 26, 28, 30, 32 | rollers |
| 34 | interior surface |
| 36, 38, 40 | resistance heaters |
| 42, 44, 46 | temperature sensors |
| 48 | rotating circuit board |
| 50 | mounted circuit board |
| 52 | controller board |
| 54 | interface board |

-continued

PARTS LIST

| | |
|---|---|
| 56 | signal |
| 58 | memory |
| 60 | microprocessor |
| 62 | processing unit |
| 64 | I/O unit |
| 66 | optical link |
| 92 | optical transmitter |
| 94 | optical detector |
| 96 | shift register |
| 98 | bit latch |
| 200 | processor drum |
| 202 | zone 1 heater |
| 204 | zone 2 heater |
| 206 | zone 3 heater |
| 208 | slip rings |
| 210 | over bus |
| 212, 214, 216 | triggering circuit |
| 218, 220, 222 | power links |
| 224 | latch |
| 226, 228, 230 | control links |
| 240 | optocoupler |
| 242 | triac |
| 250 | micoprocessor |
| 252 | overlink |
| 254 | relay circuit |
| 256 | ISO2 optocoupler |

What is claimed is:

1. A control system for reducing flicker in an electrical resistance heater comprising:

a source of AC (alternating current) current for supplying AC current to an electrical resistance heater, a bidirectional solid state switching device connected between said source and said electrical resistance heater; and a control circuit for controlling said bidirectional solid state switching device to supply a varying, phase controlled duty cycle of current to said heater which effectively ramps heater power up and down in response to a binary control signal which randomly turns on said switching device independently of the control of the temperature of said electrical resistance heater.

2. The control system of claim 1 wherein said bidirectional solid state switching device is a solid state triac.

3. The control system of claim 2 wherein said control circuit includes a random turn-on optocoupler for randomly turning on said triac and a microprocessor linked to said optocoupler for controlling said optocoupler.

4. The control system of claim 3 wherein in response to a square wave input having its transitions synchronized to said AC line zero crossing and a control input that is high, a pulse is generated to said triac after a variable delay time measured from the next AC line crossing.

5. The control system of claim 1 wherein said AC current is supplied to an electrical resistance heater located on a member for heat processing exposed photographic media.

6. The control system of claim 5 wherein said member is a rotating drum which is heated by said resistance heater and which contacts exposed photothermographic media for heat processing.

* * * * *